US006688309B2

(12) United States Patent
York

(10) Patent No.: US 6,688,309 B2
(45) Date of Patent: Feb. 10, 2004

(54) BREATHING APPARATUS AND METHOD THEREFOR

(76) Inventor: Vernon E. York, 5415 E. Emile Vola, Scottsdale, AZ (US) 85254

( * ) Notice: Subject to any disclaimer, the term of this patent is extended or adjusted under 35 U.S.C. 154(b) by 6 days.

(21) Appl. No.: 09/904,679

(22) Filed: Jul. 13, 2001

(65) Prior Publication Data

US 2003/0010343 A1 Jan. 16, 2003

(51) Int. Cl.[7] ..... A62B 7/00; A62B 9/00
(52) U.S. Cl. ..... 128/205.22
(58) Field of Search ..... 128/205.22, 201.28, 128/201.11, 202.22; 224/270

(56) References Cited

U.S. PATENT DOCUMENTS 4,949,889 A * 8/1990 Carson ..... 224/270
5,411,018 A * 5/1995 Rinehart ..... 128/201.28
5,492,110 A * 2/1996 Lenz et al. ..... 128/202.22
5,947,116 A * 9/1999 Gamow et al. ..... 128/201.11
6,070,577 A * 6/2000 Troup ..... 128/205.22

* cited by examiner

*Primary Examiner*—Henry Bennett
*Assistant Examiner*—Sabrina Dagostino
(74) *Attorney, Agent, or Firm*—Jeffrey D. Moy; Harry M. Weiss; Weiss, Moy & Harris, P.C.

(57) ABSTRACT

A breathing apparatus and method therefor having a frame capable of carrying a primary air storage tank and an emergency air storage tank, where the emergency air storage tank can either be released from the frame to replace a disabled person's tank, or the emergency air storage tank can remain on the frame and be coupled to a disabled person's face-mask by a hose thus allowing a rescuer to have both hands free in order to carry or drag a disabled person to safety

13 Claims, 1 Drawing Sheet

BREATHING APPARATUS AND METHOD THEREFOR

FIELD OF THE INVENTION

This invention relates generally to breathing apparatuses and methods therefor and, more specifically, to a breathing apparatus having a primary air storage tank and an emergency air storage tank dimensioned to provide air to a disabled person in an emergency situation.

BACKGROUND OF THE INVENTION

Firefighters and other professionals who encounter fire or other hazardous breathing environments often use a Self-Contained Breathing Apparatus (SCBA). The SCBA often consists of a tank or canister of compressed air or oxygen which is attached to a hose and subsequently to a face-mask worn by the wearer of the SCBR. The tank provides air for the wearer only, but it is often the case, that one, such as a firefighter, may discover that another person has become trapped in a hazardous atmosphere and is in need of a fresh air source. In this situation, the firefighter cannot place his face-mask on the disabled person, since this would require the firefigther to remove his own face-mask thus exposing himself to the same poisonous fumes that he is trying to prevent from harming the disabled person On Jan. 8, 1998, the Occupational Safety & Health Administration, under the U.S. Department of Labor, mandated that at least two firemen or other employees must enter what is termed the "Immediately Dangerous to Life or Health (IDLH)" atmosphere and remain in contact with each other, either by voice or visually, at all times. At the same time, at least two firemen or other employees must be located outside of the IDLE atmosphere to be available to assist the at least two employees inside in the event that a rescue or other aid is necessary This policy has been termed the "two in/two out" rule, requiring firefighters to operate in two pairs when encountering an IDLH atmosphere. The pair standing outside of the IDLH atmosphere is commonly known as a Rapid Intervention Crew (RIC) or Rapid Intervention Team (RIT). One of the scenarios that is contemplated by the two in/two out rule is the possibility that one of the firefighters in the IDLH atmosphere will run out of air or have a problem with his air storage tank. In fact, one of the required pieces of equipment at the disposal of a Rapid Intervention Crew is an additional means to bring breathing air to the disabled. In this situation, a member of the Rapid Intervention Crew must enter the IDLH atmosphere and bring an alternative air storage tank, either an additional Self Contained Breathing Apparatus or an extra SCUBA bottle with a quick-fill hose. Both an extra SCBA or an extra SCBA bottle are cumbersome to carry and require the rescuing firefighter to use one or both hands to carry.

It is often the case, however, that the disabled firefighter must also be removed from the hazardous environment. In such a situation, the rescuing firefighter must carry in an extra air storage tank, hook up the disabled fireman, and then carry both the disabled fireman and the extra air storage tank out of the hazardous setting. This is often too much of a physical burden on the rescuing fireman. Additionally, a rescuing fireman often needs both of his hands free in order to extricate a disabled fireman or other person.

A need therefore existed for an alternative breathing apparatus having a frame capable of carrying both a primary air storage tank and an emergency air storage tank, and the emergency air storage tank can either be released from the frame to replace a disabled fireman's tank, or the emergency air storage tank can remain on the frame and be coupled to a disabled fireman's face mask by a hose thus allowing the rescuing fireman to have both hands free in order to carry or drag the disabled fireman to safety.

SUMMARY OF THE INVENTION

An object of the present invention is to provide a breathing apparatus capable of providing a rescuer with two free hands in order to both provide an additional air source to a disabled person and to be able to rescue a disabled person from a hazardous environment.

It is a further object of the present invention to provide a breathing apparatus having both a primary air storage tank and an emergency air storage tank, where the emergency air storage tank is releasably coupled to a frame.

It is yet a further object of the present invention to provide a breathing apparatus having an emergency air storage tank which can remain on a frame while at the same time the emergency air storage tank is capable of providing air to a face-mask through a hose

BRIEF DESCRIPTION OF THE PREFERRED EMBODIMENTS

In accordance with one embodiment of the present invention, a breathing apparatus is disclosed, comprising, in combination, a frame dimensioned to be worn by a person, a primary air storage tank coupled to the frame, the primary air storage tank is in gas-flow communication with a hose, the hose is coupled to a primary face-mask, and an emergency air storage tank releasably coupled to the frame, the emergency air storage tank is dimensioned to be removed from the frame with a quick-release mechanism, the emergency air storage tank is in gas-flow communication with a hose, the hose is dimensioned to be coupled to a face-mask.

In accordance with another embodiment of the present invention, a method for supplying air to a disabled person is disclosed, comprising, in combination, the steps of providing a frame dimensioned to be worn by a person, providing a primary air storage tank coupled to the frame, the primary air storage tank is in gas-flow communication with a hose, the hose is coupled to a primary face-mask, providing an emergency air storage tank releasably coupled to the frame, the emergency air storage tank is dimensioned to be removed from the frame with a quick-release mechanism, the emergency air storage tank is in gas-flow communication with a hose, the hose is dimensioned to be coupled to a face-mask, wearing the frame with the primary air storage tank and the emergency air storage tank coupled to the frame, and coupling the hose of the emergency air storage tank to a face-mask.

In accordance with still another embodiment of the present invention, a method for supplying air to a disabled person is disclosed, comprising, in combination, the steps of providing a frame dimensioned to be worn by a person, providing a primary air storage tank coupled to the frame, the primary air storage tank is in gas-flow communication with a hose, the hose is coupled to a primary face-mask, providing an emergency air storage tank releasably coupled to the frame, the emergency air storage tank is dimensioned to be removed from the frame with a quick-release mechanism, the emergency air storage tank is in gas-flow communication with a hose, the hose is dimensioned to be coupled to a face-mask, wearing the frame with the primary air storage tank and the emergency air storage tank coupled to the frame, removing the emergency air storage tank from the frame, and coupling the hose of the emergency air storage tank to a face-mask The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
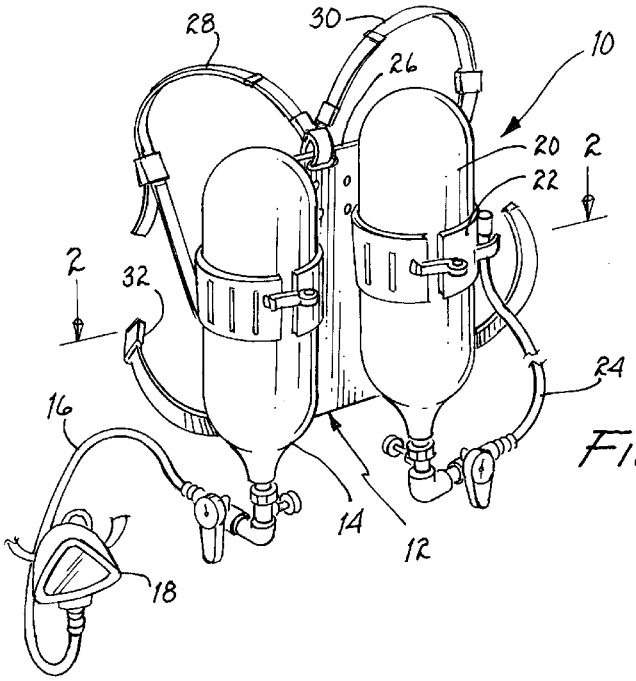
FIG. 1 is a perspective view of the preferred embodiment of the breathing apparatus of the present invention
Figure 2:
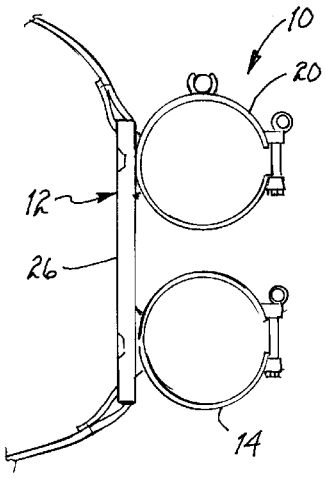
FIG. 2 is a top view of the breathing apparatus of FIG. 1, taken along line 2—2.
Figure 3:
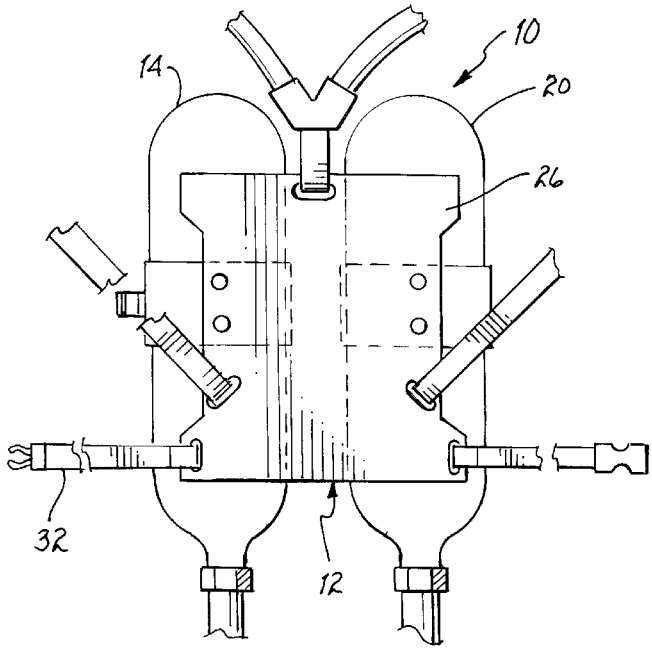
FIG. 3 is a back view of the breathing apparatus of FIG. 1

Referring to FIGS. 1–3, reference number 10 refers generally to one embodiment of the breathing apparatus of the present invention. The breathing apparatus 10 comprises a frame 12 dimensioned to be worn by a person (not shown). The breathing apparatus 10 further comprises a primary air storage tank 14 coupled to the frame 12 The primary air storage tank 12 is in gas-flow communication with a hose 16 (shown in FIG. 1). The hose 16 is coupled to a primary face-mask 18 (shown in FIG. 1). The breathing apparatus 10 also comprises an emergency air storage tank 20 releasably coupled to the frame 12. The emergency air storage tank 20 is dimensioned to be removed from the frame 12 with a quick-release mechanism 22 The emergency air storage tank 20 is in gas-flow communication with a hose 24 (shown in FIGS. 1–2), and the hose 24 is dimensioned to be coupled to a face-mask (not shown).

Preferably, the hose 24 of the emergency air storage tank 20 is of sufficient length to permit the hose 24 to be coupled to a face-mask worn by a disabled person located within at least approximately a four-foot radius of a wearer of the breathing apparatus 10 while at the same time the emergency air storage tank 20 is coupled to the frame 12. This would allow the wearer of the breathing apparatus 10 to have both hands free to initiate a rescue after having coupled the hose 24 to the face-mask of the disabled person. It should be noted that substantial benefit could be derived from a hose 24 that deviates, even substantially, from the preferred length in either direction. While, in the preferred embodiment the hose 24 of the emergency air storage tank 20 is of sufficient length to permit the hose 24 to be coupled to a face-mask worn by a disabled person located within at least approximately a four-foot radius of a wearer of the breathing apparatus 10, it should be understood that substantial benefit could be derived from an alternative configuration of the breathing apparatus 10 in which the emergency tank 20 must be released from the frame 12 in order to attach the hose 24 to the face mask, such as when a firefighter needs only to replace the faulty air storage tank of a disabled firefighters In the preferred embodiment, the hose 24 of the emergency air storage tank 20 comprises a quick-connect attachment device 34 located at an end of the hose 24 opposite the emergency air storage tank 20. The quick-connect attachment device 34 preferably comprises a first mating member 36 dimensioned to mate with a corresponding second mating member on a face-mask While, in the preferred embodiment, the hose 24 of the emergency air storage tank 20 comprises a quick-connect attachment device 34, it should be understood that substantial benefit could be derived from an alternative configuration of the breathing apparatus 10 which lacks a quick-connect attachment device 34, such as one which comprises a hose 24 having a fixed attachment to a facemask.

In the preferred embodiment, the frame 12 comprises a support member 26, a first shoulder strap 28 coupled to the support member 26, a second shoulder strap 30 coupled to the support member 26, and a belt 32 coupled to the support member 26 and dimensioned to secure the frame 12 to a waist of a person (not shown). While, in the preferred embodiment, the frame 12 comprises a support member 26, a first shoulder strap 28, a second shoulder strap 30, and a belt 32, it should be clearly understood that substantial benefit could be derived from an alternative configuration of the breathing apparatus 10 in which an alternative means for securing the primary air storage tank 14 and the emergency air storage tank 20 to a person is used, such as by coupling the tanks directly to a heavy-duty jacket.

While the intention has been particularly shown and described with reference to preferred embodiments thereof, it will be understood by those skilled in the art that the foregoing and other changes in form and details may be made therein without departing frog the spirit and scope of the invention.

I claim:

1. A method for supplying air to a disabled person comprising, in combination, the steps of:

providing a frame dimensioned to be worn by a person;

providing a primary air storage tank coupled to said frame, said primary aim storage tank is in gas-flow communication with a hose, said hose is coupled to a primary face-mask;

providing an emergency air storage tank releasably coupled to said frame, said emergency air storage tank is dimensioned to be removed from said frame with a quick-release mechanism, said emergency air storage tank is in gas-flow communication with a hose, said hose is dimensioned to be coupled to a face-mask;

wearing said frame with said primary air storage tank and said emergency air storage tank coupled to said frame; and removing said emergency air storage tank from said frame; and coupling said hose of said emergency air storage tank to a face-mask.

2. The method of claim 1 wherein said hose of said emergency air storage tank comprises a quick-connect attachment device located at an end of said hose opposite said emergency air storage tank and comprising a first mating member dimensioned to mate with a corresponding second mating member on a face-mask.

3. The method of claim 1 wherein said frame comprises the steps of:

providing a support member;

providing a first shoulder strap coupled to said support member; and providing a second shoulder strap coupled to said support member.

4. The method of claim 3 further comprising the step of providing a belt coupled to said support member and dimensioned to secure said frame to a waist of a person.

5. The method of claim 1 wherein said hose of said emergency air storage tank is of sufficient length to permit said hose to be coupled to a face-mask worn by a disabled person located within at least approximately a four-foot radius of a wearer of said breathing apparatus while at the same time said emergency air storage tank is coupled to said frame.

6. A breathing apparatus to be used during fire rescue operations comprising, in combination:

a frame dimensioned to be worn by a single fire rescue person;

a primary air storage tank coupled to the frame, the primary air storage tank being in gas-flow communication with a hose, the hose being coupled to a primary face-mask to be worn by the fire rescue person;

an emergency air storage tank releasably coupled to the frame, the emergency air storage lank is dimensioned to be removed from said frame with a quick-release mechanism to be used by a person to be rescued, the emergency air storage tank is in gas flow communication with a hose, the hose is dimensioned to be coupled to a face-mask of the person to be rescued.

7. The apparatus of claim 6 wherein the hose of the emergency air storage tank comprises a quick-connect attachment device located at an end of the hose opposite the emergency air storage tank and comprising a first mating member dimensioned to mate with a corresponding second mating member on a face-mask of the person to be rescued.

8. Of claim 6 wherein the frame comprises:

a support member;

a first shoulder strap coupled to the support member; and a second shoulder strap coupled to the support member.

9. The apparatus of claim 18 further comprising a belt coupled to the support member and dimensioned to secure the frame to a waist of the fire rescue person.

10. The apparatus of claim 6 wherein the hose of the emergency air storage tank is of sufficient length to permit the hose to be coupled to the face-mask of the person to be rescued located within at least approximately a four foot radius of the fire rescue person wearing the breathing apparatus while at the same time the emergency air storage tank is coupled to the frame.

11. A breathing apparatus to be used during fire rescue operations comprising, in combination:

a frame dimensioned to be worn by a single fire rescue person, the frame comprising:

a support member;

a first shoulder strap coupled to the support member; and a second shoulder strap coupled to the support member;

a primary air storage tank coupled to the frame, the primary air storage tank being in gas-flow communication with a hose, the hose being coupled to a primary face-mask to be worn by the fire rescue person;

an emergency air storage tank releasably coupled to the frame, the emergency air storage tank is dimensioned to be removed from said frame with a quick-release mechanism to be used by a person to be rescued, the emergency air storage tank is in gas flow communication with a hose, the hose is dimensioned to be coupled to a face-mask of the person to be rescued;

wherein the hose of the emergency air storage tank comprises a quick-connect attachment device located at an end of the hose opposite the emergency air storage tank and comprising a first mating member dimensioned to mate with a corresponding second mating member on a face-mask of the person to be rescued.

12. The apparatus of claim 11 further comprising a belt coupled to the support member and dimensioned to secure the frame to a waist of the fire rescue person.

13. The apparatus of claim 11 wherein the hose of the emergency air storage tank is of sufficient length to permit the hose to be coupled to the face-mask of the person to be rescued located within at least approximately a four foot radius of the fire rescue person wearing the breathing apparatus while at the same time the emergency air storage tank is coupled to the frame.

* * * * *